US005879271A

United States Patent [19]

Stearns et al.

[11] Patent Number: 5,879,271

[45] Date of Patent: Mar. 9, 1999

[54] EXERCISE METHOD AND APPARATUS

[76] Inventors: Kenneth W. Stearns, 8009 Cedel, Houston, Tex. 77055; Joseph D. Maresh, 19919 White Cloud Cir., West Linn, Oreg. 97068

[21] Appl. No.: 838,068

[22] Filed: Apr. 15, 1997

[51] Int. Cl.[6] ..... A63B 69/16; A63B 22/04

[52] U.S. Cl. ..... 482/51; 482/57; 482/70

[58] Field of Search ..... 482/51, 52, 53, 482/57, 62, 70, 79, 80

[56] References Cited

U.S. PATENT DOCUMENTS

| | | | |
|---|---|---|---|
| 4,185,622 | 1/1980 | Swenson | 128/25 B |
| 4,786,050 | 11/1988 | Geschwender | 272/73 |
| 5,039,088 | 8/1991 | Shifferaw | 482/57 |
| 5,279,529 | 1/1994 | Eschenbach | 482/57 |
| 5,295,928 | 3/1994 | Rennex | 482/52 |
| 5,352,169 | 10/1994 | Eschenbach | 482/57 |
| 5,383,829 | 1/1995 | Miller | 482/57 |
| 5,518,473 | 5/1996 | Miller | 482/57 |
| 5,529,554 | 6/1996 | Eschenbach | 482/57 |
| 5,529,555 | 6/1996 | Rodgers, Jr. | 482/57 |
| 5,540,637 | 7/1996 | Rodgers | 482/52 |
| 5,549,526 | 8/1996 | Rodgers, Jr. | 482/57 |
| 5,562,574 | 10/1996 | Miller | 482/51 |
| 5,573,480 | 11/1996 | Rodgers, Jr. | 482/57 |
| 5,593,372 | 1/1997 | Rodgers | 482/51 |
| 5,653,662 | 8/1997 | Rodgers | 482/70 |
| 5,690,589 | 11/1997 | Rodgers | 482/51 |

*Primary Examiner*—Stephen R. Crow
*Attorney, Agent, or Firm*—Mau & Krull, P.A.

[57] ABSTRACT

An exercise apparatus includes a support member that is movable relative to a frame, and a force receiving member that is movable relative to the support member. A first end of the support member is pivotally connected to the frame, and a second, opposite end of the support member is supported on a crank. A flexible link is interconnected between the crank and the force receiving member. The crank, the roller, the support member, and the link cooperate to move the force receiving member in a desired path.

21 Claims, 9 Drawing Sheets

EXERCISE METHOD AND APPARATUS

FIELD OF THE INVENTION

The present invention relates to exercise methods and apparatus and more particularly, to exercise equipment which facilitates exercise through a curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses some sort of linkage assembly to convert a relatively simple motion, such as circular, into a relatively more complex motion, such as elliptical. Some examples of such equipment may be found in United States patents which are disclosed in an Information Disclosure Statement submitted herewith.

Exercise equipment has also been designed to facilitate full body exercise. For example, reciprocating cables or pivoting arm poles have been used on many of the equipment types discussed in the preceding paragraph to facilitate contemporaneous upper body and lower body exercise. Some examples of such equipment may be found in United States patents which are disclosed in an Information Disclosure Statement submitted herewith.

SUMMARY OF THE INVENTION

The present invention may be seen to provide a novel linkage assembly and corresponding exercise apparatus suitable for linking circular motion to relatively more complex, generally elliptical motion. In one embodiment, for example, a support member is pivotally mounted to a frame, and a force receiving member is movably mounted on the support member. A roller is rotatably mounted on a crank to support an opposite end of the support member and pivot the support member up and down in response to rotation of the crank. A flexible link is interconnected between the crank and the force receiving member to move the force receiving member back and forth along the support member in response to rotation of the crank. Thus, as the flywheel rotates, the linkage assembly constrains the force receiving member to travel through a generally elliptical path, having a relatively longer major axis and a relatively shorter minor axis. Moreover, the linkage is such that the major axis is longer than the effective diameter of the crank.

In another respect, the present invention may be seen to provide a novel linkage assembly and corresponding exercise apparatus suitable for linking reciprocal motion to relatively more complex, generally elliptical motion. In one embodiment, for example, a handle member is pivotally connected to a frame member; and a link is interconnected between the force receiving member and a lower portion of the handle member. As the force receiving member moves through its generally elliptical path, the handle member pivots back and forth relative to the frame member.

In yet another respect, the present invention may be seen to provide a novel linkage assembly and corresponding exercise apparatus suitable for adjusting the angle of the generally elliptical path of motion relative to a horizontal surface on which the apparatus rests. In one embodiment, for example, the support member may be pivotally mounted to a first frame member which is locked in one of a plurality of positions relative to a second frame member. An increase in the elevation of the first frame member and thus, the height of the pivot axis, results in a relatively more strenuous, "uphill" exercise motion.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
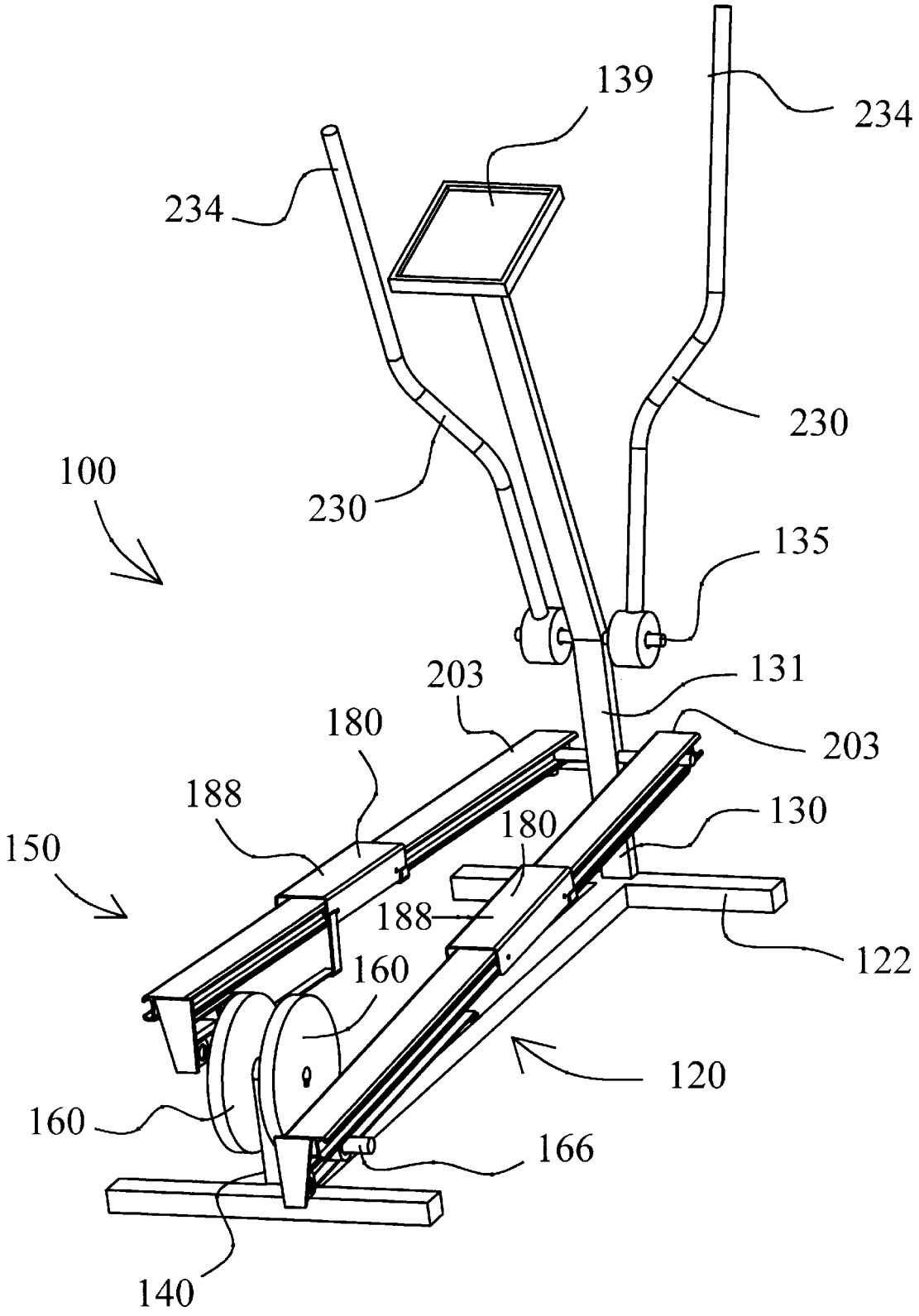
FIG. 1 is a perspective view of an exercise apparatus constructed according to the principles of the present invention.
Figure 2:
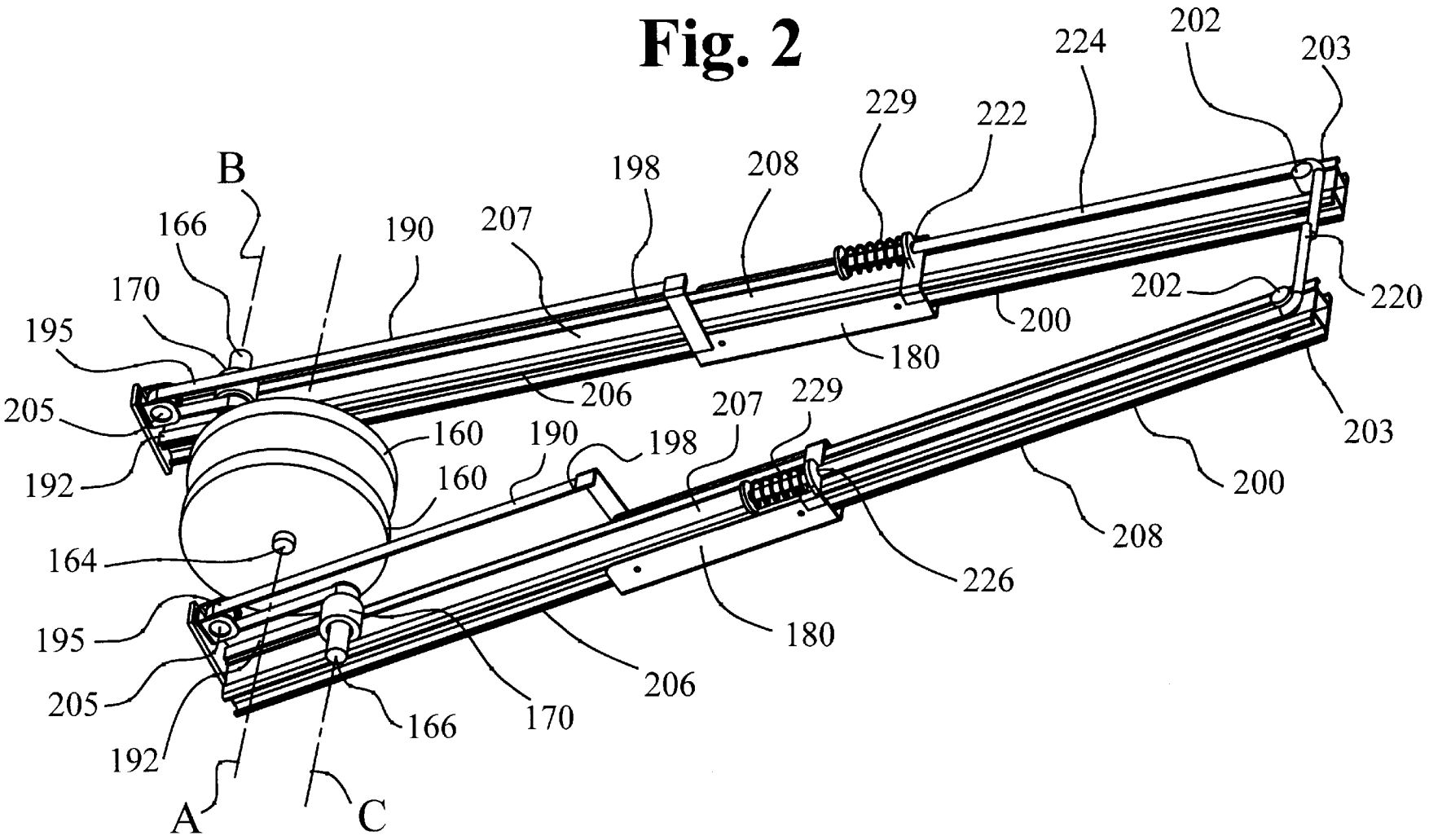
FIG. 2 is a perspective view of the underside of the linkage assembly on the exercise apparatus of FIG. 1.

A first exercise apparatus constructed according to the principles of the present invention is designated as 100 in FIGS. 1–4. The apparatus 100 generally includes a frame 120 and a linkage assembly 150 movably mounted on the frame 120. Generally speaking, the linkage assembly 150 moves relative to the frame 120 in a manner that links rotation of a flywheel 160 to generally elliptical motion of a force receiving member 180. The term "elliptical motion" is intended in a broad sense to describe a closed path of motion having a relatively longer first axis and a relatively shorter second axis (which extends perpendicular to the first axis).

The frame 120 includes a base 122, a forward stanchion or upright 130, and a rearward stanchion or upright 140. The base 122 may be described as generally I-shaped and is designed to rest upon a generally horizontal floor surface 99 (see FIGS. 3 and 4). The apparatus 100 is generally symmetrical about a vertical plane extending lengthwise through the base 122 (perpendicular to the transverse members at each end thereof), the only exception being the relative orientation of certain parts of the linkage assembly 150 on opposite sides of the plane of symmetry. In the embodiment 100, the "right-hand" components are one hundred and eighty degrees out of phase relative to the "left-hand" components. However, like reference numerals are used to designate both the "right-hand" and "left-hand" parts on the apparatus 100, and when reference is made to one or more parts on only one side of the apparatus, it is to be understood that corresponding part(s) are disposed on the opposite side of the apparatus 100. Those skilled in the art will also recognize that the portions of the frame 120 which are intersected by the plane of symmetry exist individually and thus, do not have any "opposite side" counterparts. Moreover, to the extent that reference is made to forward or rearward portions of the apparatus 100, it is to be understood that a person could exercise while facing in either direction relative to the linkage assembly 150.

The forward stanchion 130 extends perpendicularly upward from the base 122 and supports a telescoping tube or post 131. A plurality of holes 138 are formed in the post 131, and at least one hole is formed in the upper end of the stanchion 130 to selectively align with any one of the holes 138. A pin 128, having a ball detent, may be inserted through an aligned pair of holes to secure the post 131 in any of several positions relative to the stanchion 130 (and relative to the floor surface 99). An upper, distal end of the post 131 supports a user accessible platform 139 which may, for example, provide information regarding and/or facilitate adjustment of exercise parameters.

A first hole extends laterally through the post 131 to receive a shaft 133 for reasons discussed below. A second hole extends laterally through the post 131 to receive a shaft 135 relative to which a pair of handle members 230 are rotatably secured. In particular, a lower end of each of the handle members 230 is rotatably mounted on an opposite end of the shaft 135 in such a manner that each handle member 230 is independently movable relative to one another and the post 131. Resistance to handle pivoting may be provided in the form of friction discs or by other means known in the art. Each handle member 230 also includes an upper, distal portion 234 which is sized and configured for grasping by a person standing on the force receiving member 180.

The rearward stanchion 140 extends perpendicularly upward from the base 122 and supports a bearing assembly. An axle 164 is inserted through a laterally extending hole in the bearing assembly to support a pair of flywheels 160 in a manner known in the art. For example, the axle 164 may be inserted through the hole, and then a flywheel 160 may be keyed to each of the protruding ends of the axle 164, on opposite sides of the stanchion 140. Those skilled in the art will recognize that the flywheels 160 could be replaced by some other rotating member(s) which may or may not, in turn, be connected to one or more flywheels. These rotating members 160 rotate about an axis designated as A.

A radially displaced shaft 166 is rigidly secured to each flywheel 160 by means known in the art. For example, the shaft 166 may be inserted into a hole in the flywheel 160 and welded in place. The shaft 166 extends axially away from the flywheel 160 at a point radially displaced from the axis A, and thus, the shaft 166 rotates at a fixed radius about the axis A. In other words, the shaft 166 and the flywheel 160 cooperate to define a crank having a crank radius.

A roller 170 is rotatably mounted on each shaft 166. The roller 170 on the right side of the apparatus 100 rotates about an axis B, and the roller 170 on the left side of the apparatus 100 rotates about an axis C. In the embodiment 100, each of the rollers 170 has a smooth cylindrical surface which bears against and supports a rearward portion or end 206 of a respective rail or support 200. In particular, the rearward end 206 may be generally described as having an inverted U-shaped profile into which an upper portion of the roller 170 protrudes. The "base" of the inverted U-shaped profile is defined by a flat bearing surface 207 which bears against or rides on the cylindrical surface of the roller 170. Those skilled in the art will recognize that other structures (e.g. the shaft 166 alone) could be used in place of the roller 170.

Each of the rails 200 extends from the rearward end 206 to a forward end 203, with an intermediate portion 208 disposed therebetween. The forward end 203 of each rail 200 is movably connected to the frame 120, forward of the flywheels 160. In particular, the shaft 133 may be inserted into a hole extending laterally through the tube 131 and into holes extending laterally through the forward ends 203 of the rails 200. The shaft 133 may be keyed in place relative to the stanchion 130, and nuts may be secured to opposite ends of the shaft 133 to retain the forward ends 203 on the shaft 133.

A force receiving member 180 is rollably mounted on the intermediate portion 208 of each rail or track 200 in a manner known in the art. In the embodiment 100, the intermediate portions 208 may be generally described as having an I-shaped profile or as having a pair of C-shaped channels which open away from one another. Each channel 209 functions as a race or guide for one or more rollers rotatably mounted on each side of the foot skate 180. Each force receiving member or skate 180 provides an upwardly facing support surface 188 sized and configured to support a person's foot. Thus, the force receiving members 180 may be described as skates or foot skates, and the intermediate portions 208 of the rails 200 may be defined as the portions of the rails 200 along which the skates 180 may travel. Alternatively, the intermediate portions 208 may be defined as the portions of the rails 200 between the rearward ends 206 (which roll over the rollers 170) and the forward ends 203 (which are rotatably mounted to the frame 120).

In the embodiment 100, both the end portions 206 and the intermediate portions 208 of the support members 200 are linear. However, either or both may be configured as a curve without departing from the scope of the present invention. Recognizing that the rail 200 and the skate 180 cooperate to support a person's foot relative to the frame 120 and the crank 160, they may be described collectively as a foot support. Also, the rails 200 may be said to provide a means for movably interconnecting the flywheels 160 and the force receiving members 180; the rails 200 may also be said to provide a means for movably interconnecting the force receiving members 180 and the frame 120; and the rollers 170 may be said to provide a means for movably interconnecting the flywheels 160 and the rails 200.

The shafts 166 may be said to provide a means for interconnecting the flywheels 160 and the force receiving members 180. In particular, a separate flexible member or strap 190 is associated with the skate 180, rail 200, and flywheel 160 on each side of the apparatus 100. A first end 192 of each strap 190 is connected to a rail 200 proximate the rear end 206 thereof. An intermediate portion 195 of each strap 190 extends to and about the shaft 166, then to and about a pulley 205, which is rotatably mounted on the rail 200 proximate the rear end thereof. A second end 198 of each strap 190 is connected to the skate 180.

Figure 3:
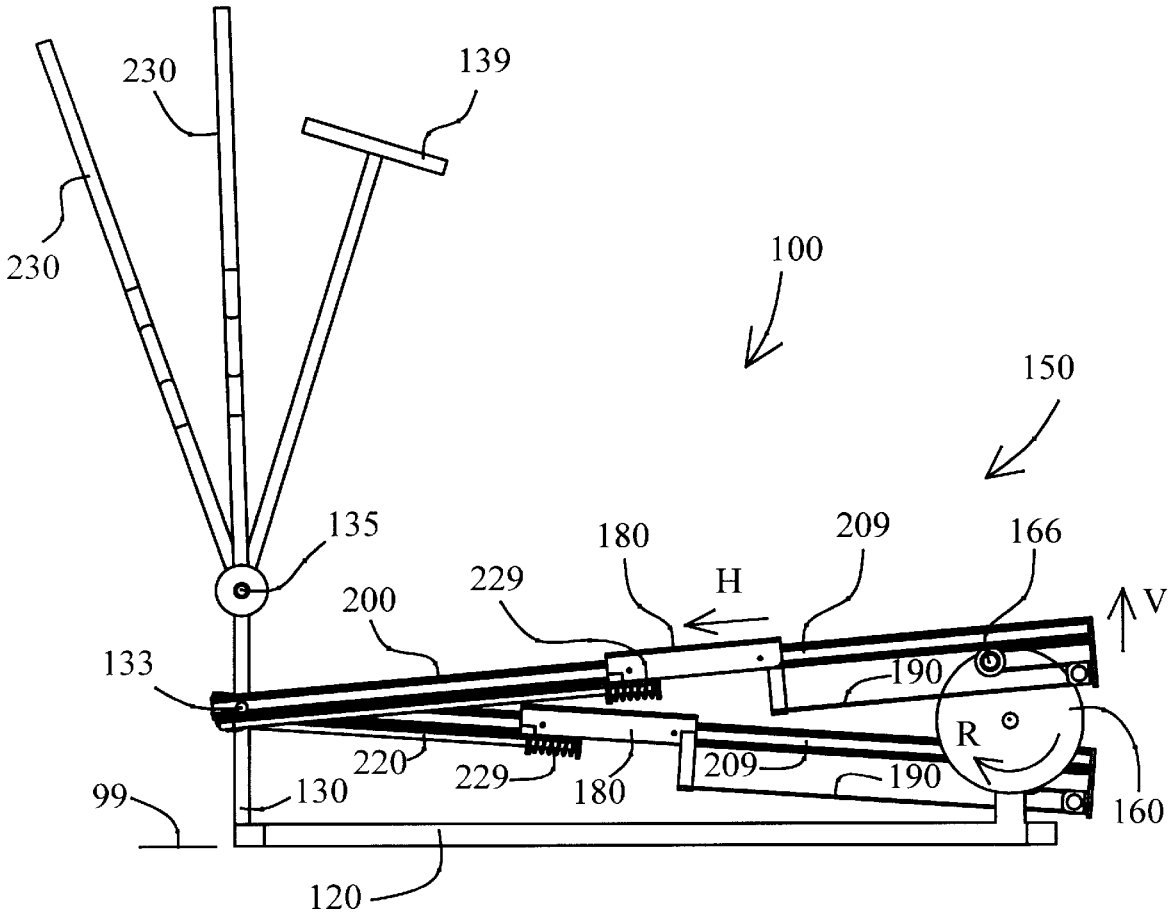
FIG. 3 is a side view of the exercise apparatus of FIG. 1, with portions broken away beneath the foot skates.
Figure 4:
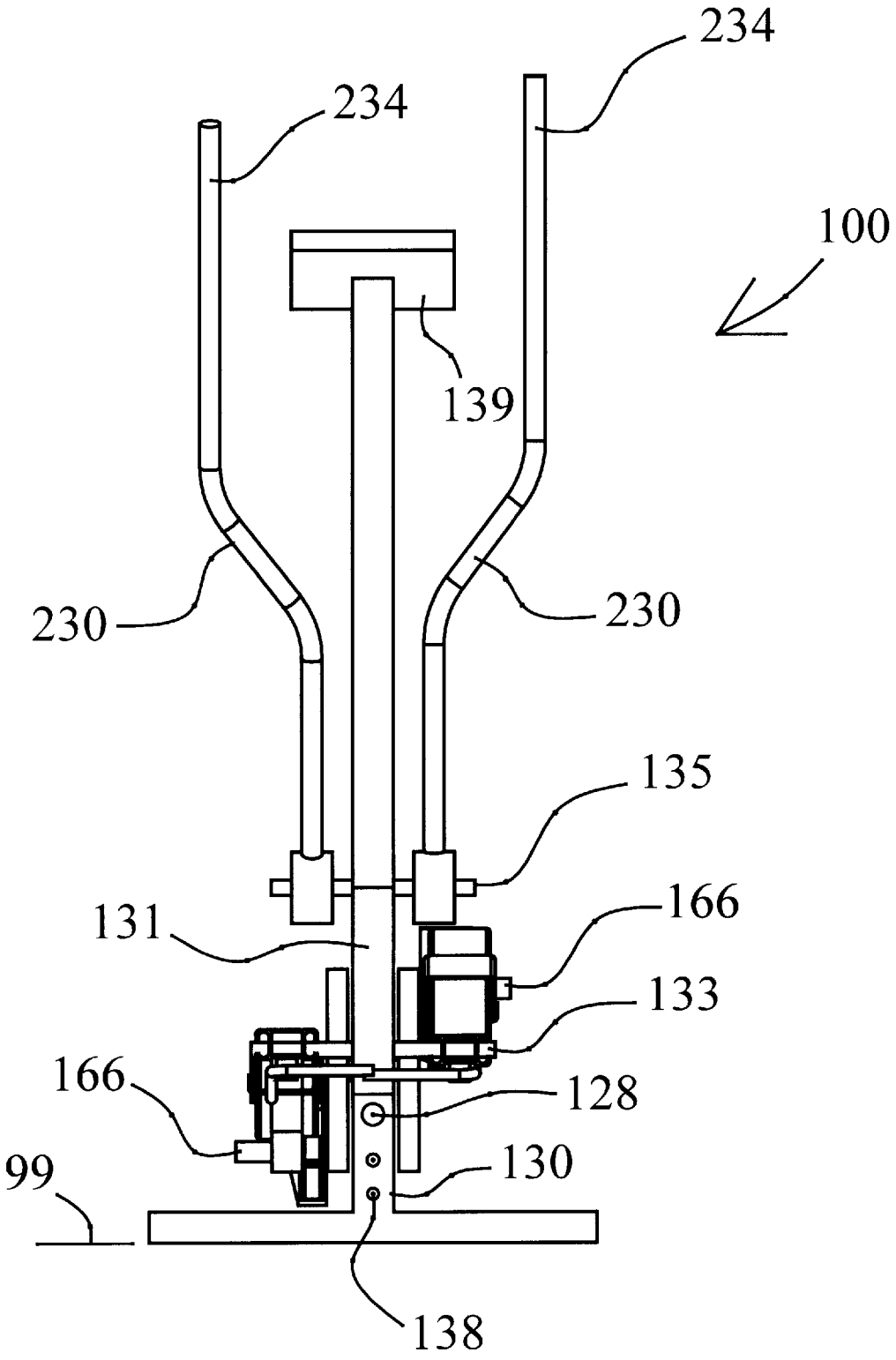
FIG. 4 is a front view of the exercise apparatus of FIG. 1.

An arrow R is shown on the left flywheel 160 in FIG. 3 to facilitate explanation of the relationship between rotation of the flywheel 160 and movement of the skate 180. As the flywheel 160 rotates in the direction R, the shaft 166 moves upward and rearward relative to the frame 120, the axis A, and the floor surface 99. Those skilled in the art will recognize that at this point in the cycle, the vertical component of the shaft's motion is significantly smaller than the horizontal component of the shaft's motion. Upward movement of the left shaft 166 causes the left rail 200 to move upward (as indicated by the arrow V), but the left rail 200 does not move rearward (or forward) because of its connection to the shaft 133 at the front stanchion 130. Recognizing that the left skate 180 is supported on the left rail 200, the left skate 180 moves upward (and downward) together with the left rail 200.

The left skate 180 also moves forward (as indicated by the arrow H) relative to the left rail 200, as the right skate 180 moves rearward relative to the right rail 200. In particular, on the right side of the apparatus 100, the right shaft 166 pulls forward on the intermediate portion 195 of the right strap 190, which is routed in a manner that requires the right foot skate 180 to move rearward twice as much as the right shaft 166 moves forward; and similarly on the left side of the apparatus 100, movement of the left shaft 166 one inch rearward coincides with movement of the left skate 180 two inches forward. In other words, each skate 180 travels fore and aft through a range of motion equal to four times the radial displacement between the axle 164 and a respective shaft 166. Those skilled in the art will recognize that the straps 190 could be routed in other ways to obtain different ratios between foot skate travel and the effective crank radius. Those skilled in the art will also recognize that the components of the linkage assembly 150 may also be arranged in other ways relative to one another without altering the ratio between foot skate travel and the effective crank radius.

A third flexible member or cord 220 is interconnected between the left skate 180 and the right skate 180 to constrain them to move in reciprocating fashion along their respective tracks 200. In particular, a first end 222 of the cord 220 is connected to the right skate 180. An intermediate portion 224 of the cord 220 extends to and about a post 202, extending downward from the right rail 200 proximate the forward end 203 thereof, then to and about a post 202, extending downward from the left rail 200 proximate the forward end 203 thereof. Those skilled in the art will recognize that rollers could be mounted on the posts 202 to facilitate movement of the cord 220 relative thereto. A second, opposite end 226 of the cord 220 is connected to the left skate 180. A spring 229 is placed in series with each end 224 and 226 of the cord 220 to keep the cord 220 taut while also allowing sufficient freedom of movement during operation.

Recognizing that the flexible members 220 and 190 cooperate to link the skates 180 to one another and to the cranks 160, the cord 220 may be said to provide a means for interconnecting the skates 180, and the straps 190 may be said to provide a link between and/or a means for interconnecting the skates 180 and the cranks 160.

For ease of reference in both this detailed description and the claims set forth below, the components are sometimes described with reference to "ends" having a particular characteristic and/or being connected to another part. For example, the cord 220 may be said to have a first end connected to the right skate and a second end connected to the left skate. However, those skilled in the art will recognize that the present invention is not limited to links or members which terminate immediately beyond their points of connection with other parts. In other words, the term "end" should be interpreted broadly, in a manner that could include "rearward portion", for instance; and in a manner wherein "rear end" could simply mean "behind an intermediate portion", for instance. For example, a single flexible member could be used in place of the two straps 200 and the one cord 220, with intermediate portions thereof rigidly secured to the foot skates.

Figure 5:
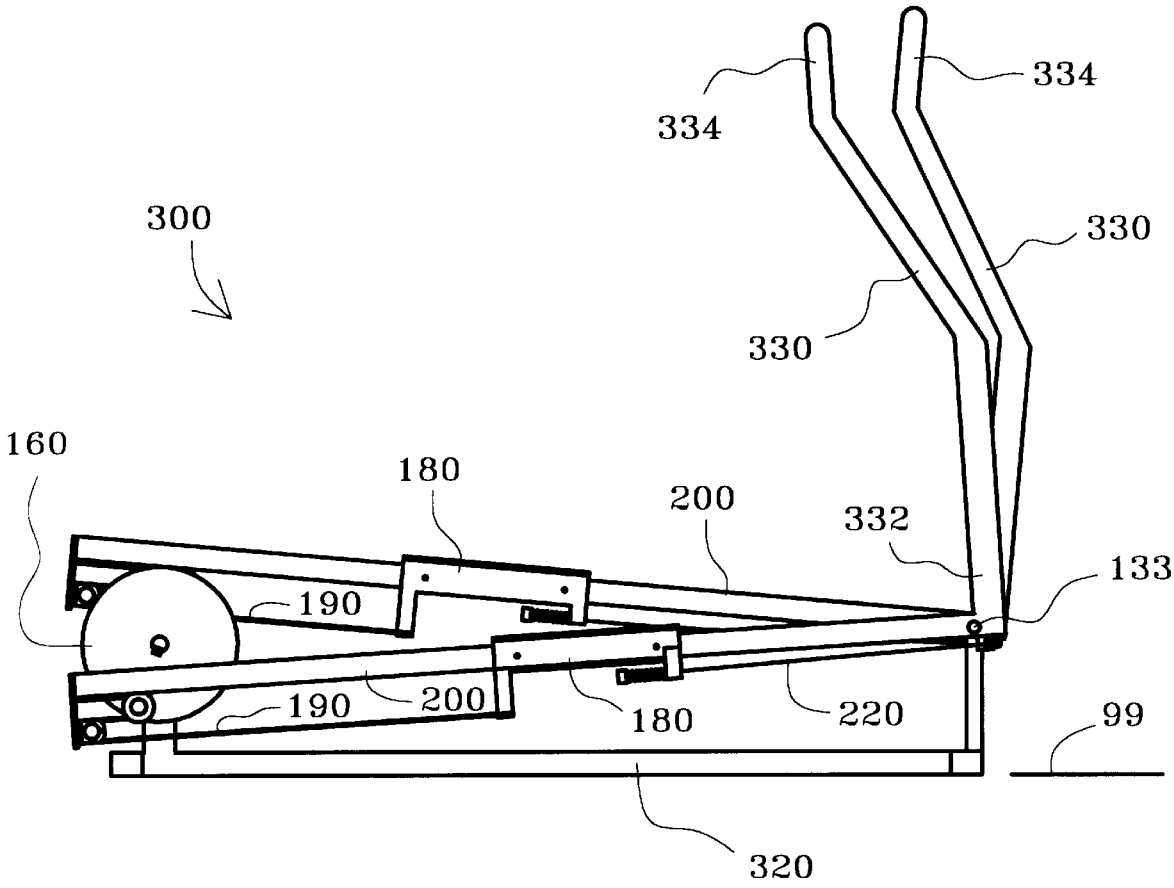
FIG. 5 is a side view of a first alternative embodiment to the exercise apparatus of FIG. 1, with portions broken away beneath the foot skates.

The embodiment 100 provides leg exercise motion together with the option of independent arm exercise motion. However, linked or interconnected leg and arm exercise motions are also available in accordance with the present invention. For example, in FIG. 5, an exercise apparatus 300 provides leg exercise motion identical to that of the first apparatus 100. Among other things, the front ends of the rails 200 are likewise pivotally mounted to the frame 320 by means of the shaft 133. However, the apparatus 300 has handle members 330 which are rigidly secured to the rails 200, rather than rotatably mounted directly to the frame. In particular, each of the handle members 330 extends from a first or lower end 332, which is welded to the front end of the rail 200, to a second or upper end 334, which is sized and configured for grasping by a person standing on the skates 180. As a result, the handle ends 334 are constrained to pivot back and forth as the rails 200 pivot up and down.

Figure 6:
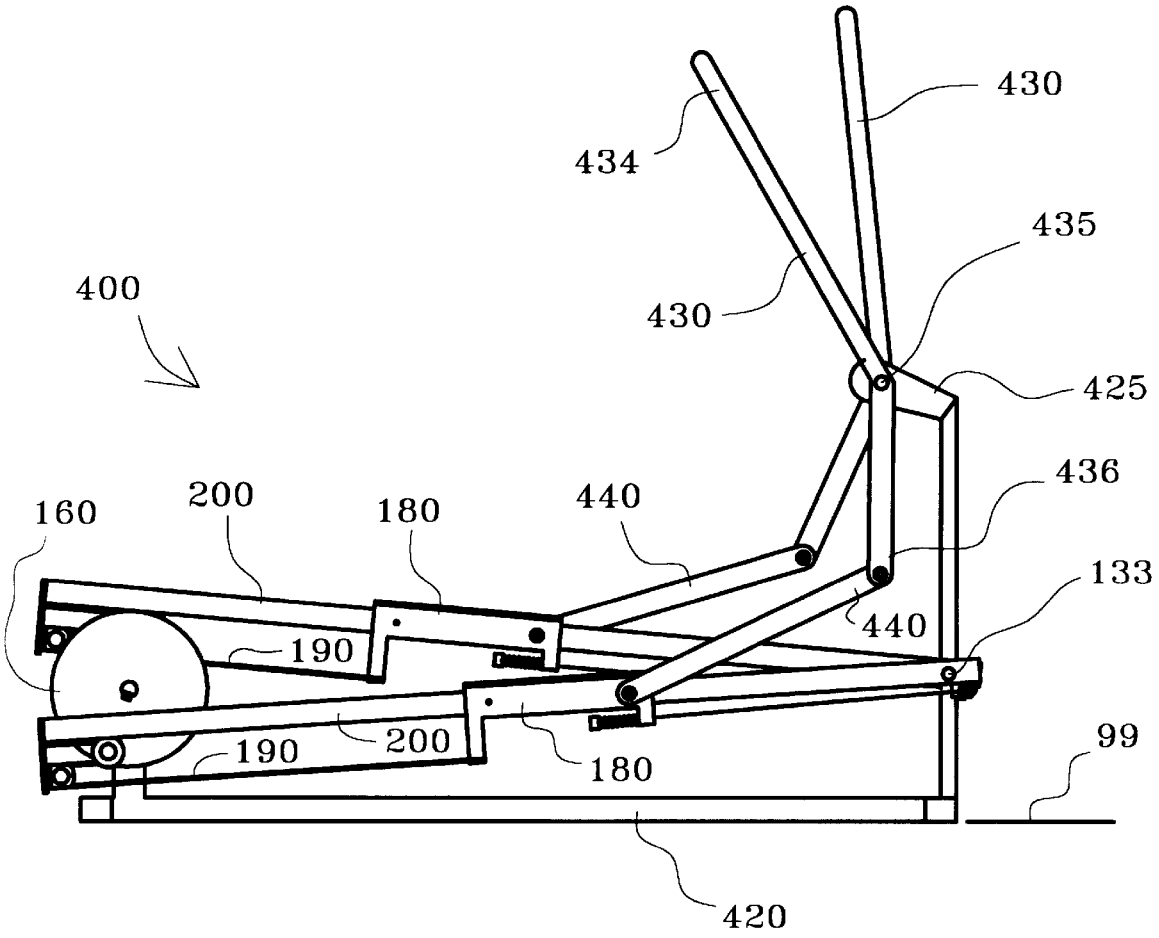
FIG. 6 is a side view of a second alternative embodiment to the exercise apparatus of FIG. 1, with portions broken away beneath the foot skates.

Another "linked" embodiment of the present invention is designated as 400 in FIG. 6. The exercise apparatus 400 provides leg exercise motion identical to that of the first apparatus 100. Among other things, the front ends of the rails 200 are likewise pivotally mounted to the frame 420 by means of the shaft 133 at a first elevation above the floor surface 99. Each handle member 430 has an intermediate portion 435 which is pivotally connected to a trunnion 425 disposed on the frame 420 at a second, relatively greater elevation above the floor surface 99. An upper, distal portion 434 of each handle member 430 is sized and configured for grasping by a person standing on the force receiving member 180. A lower, distal portion 436 of each handle member 430 is rotatably connected to one end of a handle link 440. An opposite end of the handle link 440 is rotatably connected to the force receiving member 180. As a result, the handle members 430 are constrained to pivot back and forth as the force receiving members 180 move through a generally elliptical path of motion.

Figure 7:
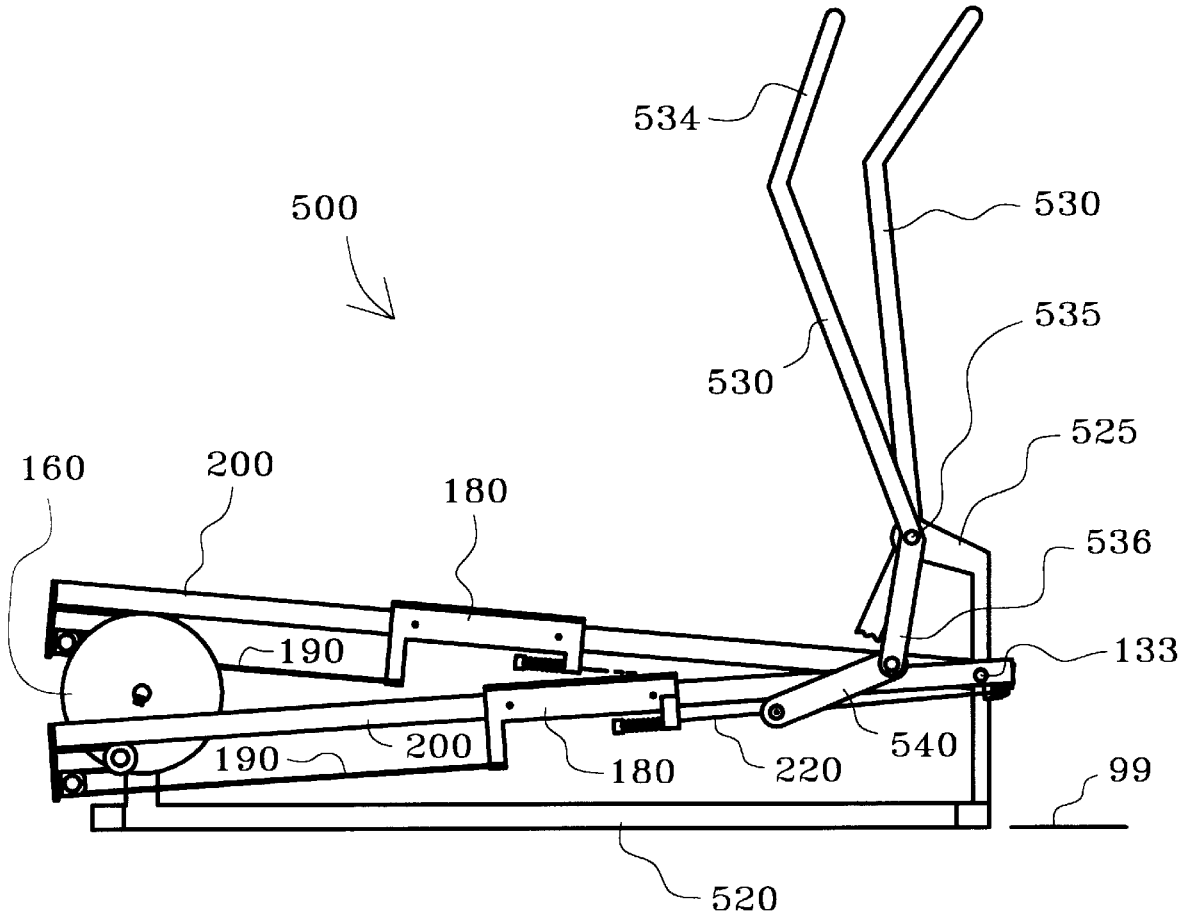
FIG. 7 is a side view of a third alternative embodiment to the exercise apparatus of FIG. 1, with portions broken away beneath the foot skates.

Yet another "linked" embodiment of the present invention is designated as 500 in FIG. 7. The exercise apparatus 500 provides leg exercise motion identical to that of the first apparatus 100, and among other things, the front ends of the rails 200 are likewise pivotally mounted to the frame 520 by means of the shaft 133 at a first elevation above the floor surface 99. Each handle member 530 has an intermediate portion 535 which is pivotally connected to a trunnion 525 disposed on the frame 520 at a second, relatively greater elevation above the floor surface 99. An upper, distal portion 534 of each handle member 530 is sized and configured for grasping by a person standing on the force receiving member 180. A lower, distal portion 536 of each handle member 530 is rotatably connected to one end of a handle link 540. An opposite end of the handle link 540 is fixedly secured to the cord 220. As a result, the handle members 530 are constrained to pivot back and forth as the juncture points on the cord 220 move through a generally elliptical path of motion.

Figure 8:
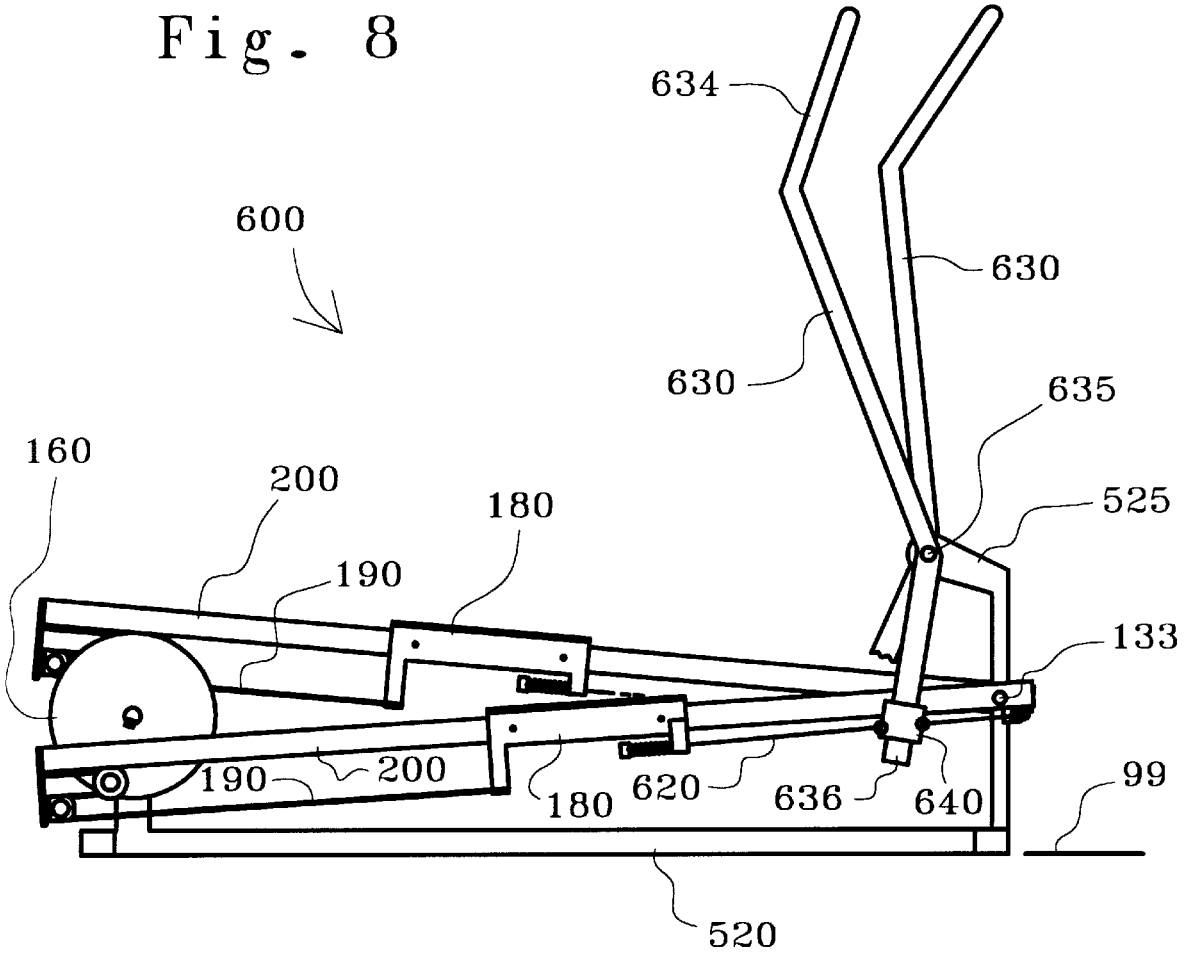
FIG. 8 is a side view of a fourth alternative embodiment of the exercise apparatus of FIG. 1, with portions broken away beneath the foot skates.

Still another "linked" embodiment of the present invention is designated as 600 in FIG. 8. The exercise apparatus 600 provides leg exercise motion identical to that of the first apparatus 100. Among other things, the front ends of the rails 200 are likewise pivotally mounted to the frame 520 by means of the shaft 133 at a first elevation above the floor surface 99. Each handle member 630 has an intermediate portion 635 which is pivotally connected to a trunnion 525 disposed on the frame 520 at a second, relatively greater elevation above the floor surface 99. An upper, distal portion 634 of each handle member 630 is sized and configured for grasping by a person standing on the force receiving member 180. A lower, distal portion 636 of each handle member 630 extends into a ring 640 which, in turn, is fixedly secured to the cord 620. Those skilled in the art will recognize that the cord 620 may be a single cord or three separate pieces of cord extending from one skate 180 to the other. In any event, the handle members 630 are constrained to pivot back and forth as the rings 640 move through a generally elliptical path of motion (sliding up and down along the lower portion 636 of the handle member 630).

Figure 9:
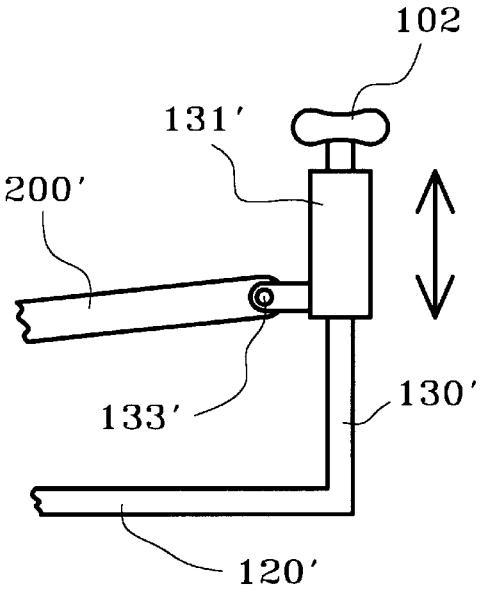
FIG. 9 is a diagrammatic side view of an elevation adjustment mechanism suitable for use on exercise apparatus constructed in accordance with the principles of the present invention.

With any of the foregoing embodiments, the orientation of the path traveled by the force receiving members 180 may be adjusted by raising or lowering the shaft 133 relative to the floor surface 99. One such mechanism for doing so is the detent pin arrangement shown and described with reference to the first embodiment 100. Another suitable mechanism is shown diagrammatically in FIG. 9, wherein a frame 120' includes a post 131' movable along an upwardly extending stanchion 130', and a rail 200' is rotatably mounted to the post 131' by means of a shaft 133'. A knob 102 is rigidly secured to a lead screw which extends through the post 131' and threads into the stanchion 130'. The knob 102 and the post 131' are interconnected in such a manner that the knob 102 rotates relative to the post 131', but they travel up and down together relative to the stanchion 130' (as indicated by the arrows).

Figure 10:
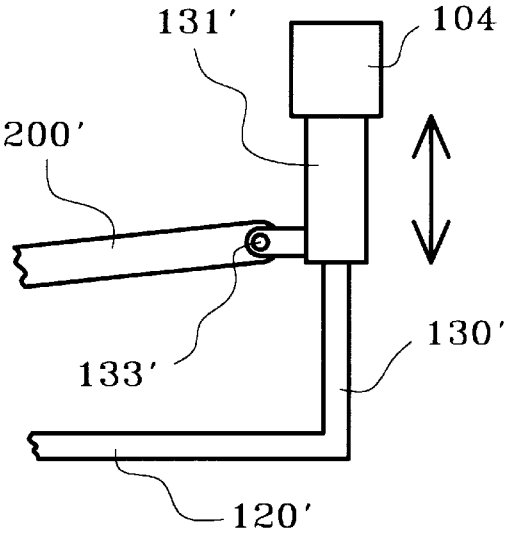
FIG. 10 is a diagrammatic side view of another elevation adjustment mechanism suitable for use on exercise apparatus constructed in accordance with the principles of the present invention.

Yet another suitable adjustment mechanism is shown diagrammatically in FIG. 10, wherein again, a frame 120' includes a post 131' movable along an upwardly extending stanchion 130', and a rail 200' is rotatably mounted to the post 131' by means of a shaft 133'. An actuator 104, such as a motor or a hyrdaulic drive, is rigidly secured to the post 131' and connected to a shaft which extends through the post 131' and into the stanchion 130'. The actuator 104 selectively moves the shaft relative to the post 131', causing the actuator 104 and the post 131' to travel up and down together relative to the shaft and the stanchion 130' (as indicated by the arrows). The actuator 104 may operate in response to signals from a person and/or a computer controller.

Although the present invention has been described with reference to particular embodiments and applications, those skilled in the art will recognize additional embodiments, modifications, and/or applications which fall within the scope of the present invention. For example, in addition to the variations discussed above, one skilled in the art might be inclined to add any of various known inertia altering devices, including, for example, a motor, a "stepped up" flywheel, or an adjustable brake of some sort. Furthermore, although rotationally interconnected components may be shown to be simply cantilevered relative to one another, the components could be modified so that an end of a first component nested between opposing prongs on the end of a second component. Therefore, recognizing that for reasons of practicality the foregoing description sets forth only some of the numerous possible modifications and variations, the scope of the present invention is to be limited only to the extent of the claims which follow.

What is claimed is:

1. An exercise apparatus, comprising:

a frame designed to rest upon a floor surface;

a left crank and a right crank, wherein each said crank is rotatably mounted on the frame and rotatable about a crank axis;

a left first support and a right first support, wherein each said first support is mounted on the crank at a radial distance from the crank axis;

a left second support and a right second support, wherein each said second support has a forward portion, a rearward portion, and an intermediate portion extending therebetween, wherein the forward portion of each said second support is rotatably connected to the frame and pivotal relative thereto about a pivot axis, and the rearward portion of each said second support is supported by a respective first support;

a left force receiving member and a right force receiving member, wherein each said force receiving member is sized and configured to support a foot of a standing person, and each said force receiving member is movably mounted on the intermediate portion of a respective second support; and a left link and a right link, wherein each said link is interconnected between a respective force receiving member and the rearward portion of a respective second supports, and each said link moves relative to a respective second support during rotation of a respective crank, and each said link cooperates with a respective second support, and a respective first support, and a respective crank to move a respective force receiving member through a generally elliptical path relative to the frame.

2. The exercise apparatus of claim 1, wherein each said first support includes a roller rotatably mounted on a respective crank and underlying the rearward portion of a respective second support.

3. The exercise apparatus of claim 1, wherein a left handle is rigidly mounted on the forward portion of the left second support and pivots together therewith relative to the frame, and a right handle is rigidly mounted on the forward portion of the right second support and pivots together therewith relative to the frame.

4. The exercise apparatus of claim 1, wherein a handle is pivotally mounted on the frame and linked to the force receiving member.

5. The exercise apparatus of claim 4, wherein a rigid link has a first end rotatably connected to a lower end of the handle, and a second end rotatably connected to the force receiving member.

6. The exercise apparatus of claim 1, wherein each said link is a flexible member which extends from a respective force receiving member to and about a guide on the rearward portion of a respective second support, then to and about a respective first support, then to the rearward portion of a respective second support.

7. The exercise apparatus of claim 1, further comprising a flexible member interconnected between the left force receiving member and the right force receiving member.

8. The exercise apparatus of claim 7, wherein a handle is pivotally mounted on the frame and linked to the flexible member.

9. The exercise apparatus of claim 8, wherein a rigid link has a first end rotatably connected to a lower end of the handle, and a second end rotatably connected to the flexible member.

10. The exercise apparatus of claim 8, wherein a tube is secured to the flexible member, and a lower end of the handle extends into and slides relative to the tube.

11. An exercise apparatus, comprising:

a frame designed to rest upon a floor surface;

a left crank and a right crank, wherein each said crank is rotatably mounted on the frame and rotatable about a crank axis;

a left first support and a right first support, wherein each said first support is mounted on the crank at a radial distance from the crank axis;

a left second support and a right second support, wherein each said second support has a forward portion, a rearward portion, and an intermediate portion extending therebetween, wherein the forward portion of each said second support is rotatably connected to the frame and pivotal about a pivot axis, and the rearward portion of each said second support is supported by a respective first support;

a left force receiving member and a right force receiving member, wherein each said force receiving member is sized and configured to support a foot of a standing person, and each said force receiving member is movably mounted on the intermediate portion of a respective support member; and a left flexible member and a right flexible member, wherein each said flexible member is interconnected between a respective force receiving member and the crank, and each said flexible member cooperates with a respective second support, a respective first support, and a respective crank to move a respective force receiving member through a generally elliptical path relative to the frame.

12. The exercise apparatus of claim 11, wherein each said first support includes a roller rotatably mounted on a respective crank and underlying the rearward portion of a respective second support.

13. The exercise apparatus of claim 11, wherein an end of each said flexible member is connected to the rearward portion of a respective second support.

14. The exercise apparatus of claim 13, wherein an intermediate portion of each said flexible member is routed at least once about a respective first support.

15. The exercise apparatus of claim 14, wherein the intermediate portion of each said flexible member is routed at least once about at least one guide on the rearward portion of a respective second support.

16. The exercise apparatus of claim 13, wherein an opposite end of each said flexible member is connected to a respective force receiving member.

17. The exercise apparatus of claim 11, wherein an intermediate portion of each said flexible member is routed at least once about a respective first support.

18. The exercise apparatus of claim 11, wherein an intermediate portion of each said flexible member is routed at least once about at least one guide on the rearward portion of a respective second support.

19. The exercise apparatus of claim 18, wherein the intermediate portion of each said flexible member is routed at least once about a respective first support.

20. The exercise apparatus of claim 11, wherein each said force receiving member is rollably mounted on a respective second support.

21. An exercise apparatus, comprising:

a frame designed to rest upon a floor surface;

a left crank and a right crank, wherein each said crank is rotatably mounted on the frame and rotatable about a crank axis;

a left roller and a right roller, wherein each said roller is mounted on the crank at a radial distance from the crank axis;

a left support and a right support, wherein each said support has a forward portion, a rearward portion, and an intermediate portion extending therebetween, wherein the forward portion of each said support is rotatably connected to the frame, and the rearward portion of each said support is supported by a respective roller;

a left force receiving member and a right force receiving member, wherein each said force receiving member is sized and configured to support a foot of a standing person, and each said force receiving member is movably mounted on the intermediate portion of a respective support; and a left link and a right link, wherein each said link is interconnected between a respective force receiving member and a respective support, wherein each said link cooperates with a respective support, a respective roller, and a respective crank to move a respective force receiving member through a generally elliptical path relative to the frame.

* * * * *